US012704352B2

(12) United States Patent
Binkholder et al.

(10) Patent No.: US 12,704,352 B2
(45) **Date of Patent: *Aug. 11, 2026**

(54) AIRCRAFT WEAPONS POD INCLUDING RAIL LAUNCHER

(71) Applicant: The Boeing Company, Arlington, VA (US)

(72) Inventors: Ryan Glen Binkholder, Webster Groves, MO (US); John Kevin Foster, St. Peters, MO (US)

(73) Assignee: The Boeing Company, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/968,621

(22) Filed: Dec. 4, 2024

(65) Prior Publication Data

US 2025/0093129 A1 Mar. 20, 2025

Related U.S. Application Data

(63) Continuation of application No. 14/620,486, filed on Feb. 12, 2015.

(51) Int. Cl.

| | |
|---|---|
| ***F41F 3/077*** | (2006.01) |
| ***F41F 3/06*** | (2006.01) |
| *F41A 23/24* | (2006.01) |

(52) U.S. Cl.

CPC ..... *F41F 3/077* (2013.01); *F41F 3/06* (2013.01); *F41A 23/24* (2013.01)

(58) Field of Classification Search

None

See application file for complete search history.

(56) References Cited

U.S. PATENT DOCUMENTS

| | | | | | |
|---|---|---|---|---|---|
| 2,438,924 | A | * | 4/1948 | Kramer | F41A 25/02 89/31 |
| 2,609,730 | A | | 9/1952 | Bergstrom | |
| 2,723,093 | A | | 11/1955 | Price et al. | |
| 2,731,885 | A | * | 1/1956 | Nolan | B64D 1/06 89/1.806 |
| 2,790,352 | A | * | 4/1957 | Jewett | F41F 3/06 89/1.817 |
| 2,816,483 | A | * | 12/1957 | Johnston | F41F 3/06 89/1.817 |
| 2,844,073 | A | * | 7/1958 | Re | F41F 3/065 89/1.807 |
| 2,848,925 | A | * | 8/1958 | Hood | F41F 3/052 89/1.806 |
| 2,921,501 | A | | 1/1960 | Charles et al. | |
| 2,930,288 | A | * | 3/1960 | Jonah | F42B 5/035 89/1.817 |
| 2,931,273 | A | * | 4/1960 | Weatherhead, Jr. | F41F 3/065 89/1.817 |
| 2,958,260 | A | | 11/1960 | Anderson | |
| 3,172,623 | A | * | 3/1965 | Ward | B64C 29/005 244/55 |

(Continued)

FOREIGN PATENT DOCUMENTS

WO 2009045577 A1 4/2009

*Primary Examiner* — Derrick R Morgan

(74) *Attorney, Agent, or Firm* — Harrity & Harrity, LLP

(57) ABSTRACT

An aircraft comprising a weapons pod including an enclosure mounted to an outer mold line of the aircraft, and at least one missile rail launcher mounted entirely within and fixed to the enclosure.

20 Claims, 5 Drawing Sheets

(56) References Cited

U.S. PATENT DOCUMENTS 3,412,640 A 11/1968 Nash
3,499,364 A 3/1970 Ooge et al.
3,789,729 A 2/1974 Aupy et al.
3,967,529 A 7/1976 Ingle et al.
4,040,334 A * 8/1977 Smethers, Jr. ..... F41F 3/06 89/1.804
4,106,389 A * 8/1978 Walley ..... F41F 3/06 89/1.816
4,134,328 A 1/1979 Asp et al.
4,184,801 A 1/1980 Nicoloff et al.
4,342,252 A * 8/1982 Hagelberg ..... F41F 3/06 89/1.816
4,429,611 A 2/1984 Oldham et al.
4,455,917 A 6/1984 Shook
4,660,456 A * 4/1987 Griffin ..... F41F 3/06 89/1.819
4,702,145 A 10/1987 Kannapell et al.
4,756,226 A * 7/1988 Piesik ..... F41F 3/0413 89/1.816
5,115,711 A 5/1992 Bushagour et al.
5,148,734 A 9/1992 Lilly
5,153,367 A * 10/1992 Markquart ..... F41F 3/042 89/1.816
5,162,605 A * 11/1992 Piesik ..... F41F 3/077 89/1.816
5,400,689 A 3/1995 Huetter et al.
5,877,696 A * 3/1999 Powell ..... G08B 13/149 340/5.31
5,904,323 A 5/1999 Jakubowski, Jr. et al.
6,060,411 A 5/2000 Cline et al.
6,543,328 B1 4/2003 Plummer et al.
7,610,841 B2 11/2009 Padan
7,966,921 B1 6/2011 Alday
8,158,915 B2 4/2012 Earle
8,893,605 B1 11/2014 Hester, Jr. et al.
2002/0096041 A1 7/2002 Briggs et al.
2008/0105112 A1 5/2008 Grabmeier
2009/0100995 A1 4/2009 Fisher
2009/0100996 A1 4/2009 Jakubowski, Jr. et al.
2009/0109063 A1 4/2009 Grimshaw et al.
2012/0137653 A1 6/2012 Facciano et al.
2013/0221158 A1* 8/2013 Binkholder ..... B64D 7/08 89/1.51
2015/0053073 A1* 2/2015 Kalms ..... F41F 3/0406 89/1.819
2015/0075357 A1* 3/2015 Bugge ..... F41F 3/042 89/1.815
2015/0101478 A1 4/2015 Palmer et al.
2020/0247540 A1* 8/2020 Jones ..... B64D 7/08
2024/0328752 A1* 10/2024 Binkholder ..... F41F 3/06

* cited by examiner

AIRCRAFT WEAPONS POD INCLUDING RAIL LAUNCHER

RELATED APPLICATION

This application is a continuation of U.S. patent application Ser. No. 14/620,486, filed Feb. 12, 2015, which is incorporated herein by reference in its entirety.

BACKGROUND

Certain aircraft are equipped with air-launched missile systems. In one type of system, the missiles may be stored inside the aircraft. In another type of system, the missiles may be mounted to an outer mold line of the aircraft.

Each type of system has its own advantages and disadvantages. For the first type of system, the aircraft hides the radar signature of the missiles. However, available internal volume is reduced for fuel, avionics, mid other subsystems.

Moreover, the missiles are deployed from the aircraft and moved out into the airstream prior to launch. The missiles may be kinematically deployed by a kinematic mechanism such as a trapeze-type mechanism. The trapeze-type mechanism is relatively complex and heavy, and it further reduces internal volume. The trapeze mechanism also adds delay to the launch timeline due to the extension of a trapeze.

For the second type of system, the rail launchers are mounted to the outer mold line to maximize the internal volume impact. However, the radar signatures of the missiles are exposed. Moreover, the rail, launchers and missiles increase aerodynamic drag,

SUMMARY

According to an embodiment herein, an aircraft comprises a weapons pod mounted to an outer mold line of the aircraft, and at least one missile rail launcher mounted entirely within and fixed to the weapons pod.

According to another embodiment herein, a missile launch system mountable to an outer mold line of an aircraft comprises an enclosure having forward and aft doors, at least one rail launcher mounted entirely within and fixed to the enclosure, and a controller and drive mechanisms for opening the aft door and then the forward door to create an airstream through the enclosure prior to missile launch.

According to another embodiment herein, a weapons pod comprises an enclosure including a sidewall and a centerline keel, and a plurality of rail launchers fixed to the centerline keel. The sidewall surrounds the centerline keel and the rail launchers.

These features and functions may be achieved independently in various embodiments or may be combined in other embodiments. Further details of the embodiments can be seen with reference to the following description and drawings.

DETAILED DESCRIPTION

Figure 1A:
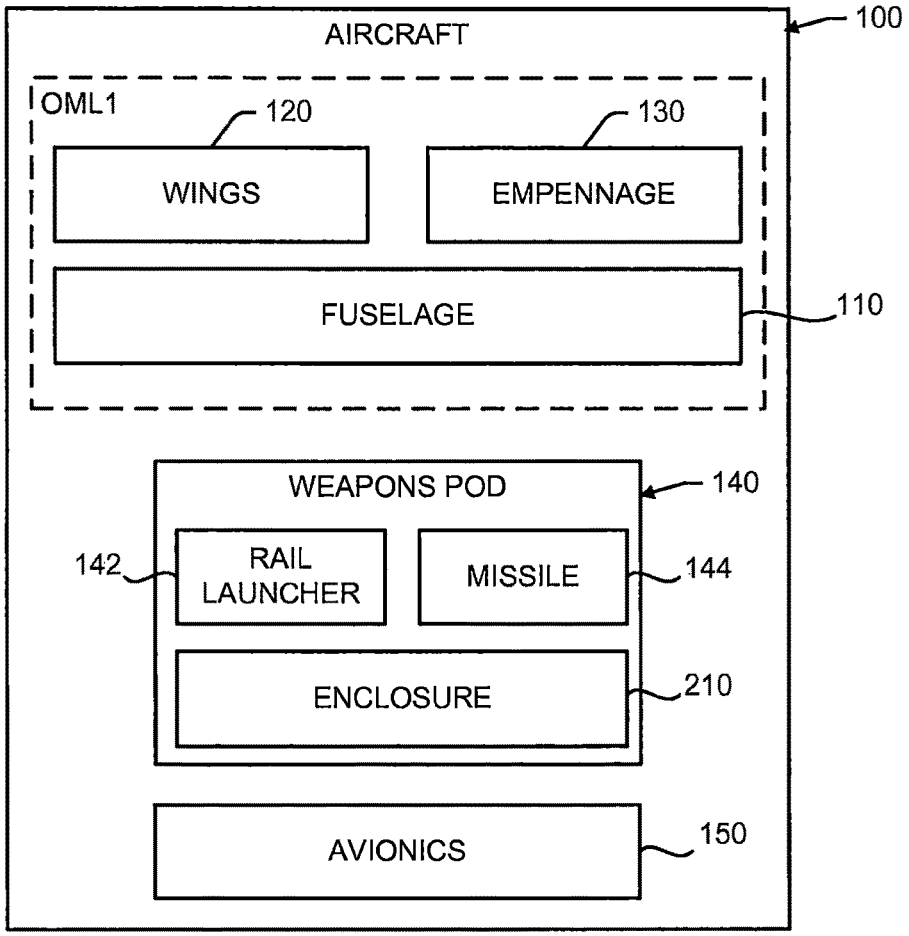
FIG. 1A is an illustration of an aircraft including a weapons pod.

Reference is made to FIG. 1A, which illustrates an aircraft 100 including a fuselage 110, wings 120, and empennage 130. External surfaces of the fuselage 110, the wings 120, and the empennage 130 define an outer mold line (OML1) of the aircraft 100.

The aircraft 100 further includes a weapons pod 140 mounted to the outer mold line (OML1) of the aircraft 100. The weapons pod 140 may be mounted to a lower outer mold line (OML1) of a wing 120. In the alternative, the weapons pod 140 may be mounted to a lower outer mold line (OML1) of the fuselage 110 (e.g., the lower centerline station).

The weapons pod 140 includes an enclosure 210, at least one missile rail launcher 142 mounted entirely within and fixed to the enclosure 210, and at least one air-launched missile 144. Examples of the rail launcher 142 include the LAU-128 rail launcher and LAU-129 rail launcher. Each rail launcher 142 carries an air-launched missile 144. Examples of the air launched missile 144 include an air-to-air missile and an air-to-surface missile. Each missile 144 is enclosed entirely by the weapons pod 140 prior to launch.

A single weapons pod 140 is illustrated in FIG. 1A. However, the aircraft 100 may have at least one additional weapons pods 140 mounted to its outer mold line (OML1).

The aircraft 100 further includes avionics 150, which is typically housed within the fuselage 110. To launch a missile 144, the avionics 150 may pass target information to the missile 144, command doors of the weapons pod 140 to open and close, command a rail of the missile's rail launcher 142 to unlatch, and command the missile's rocket motor to fire.

Figure 1B:
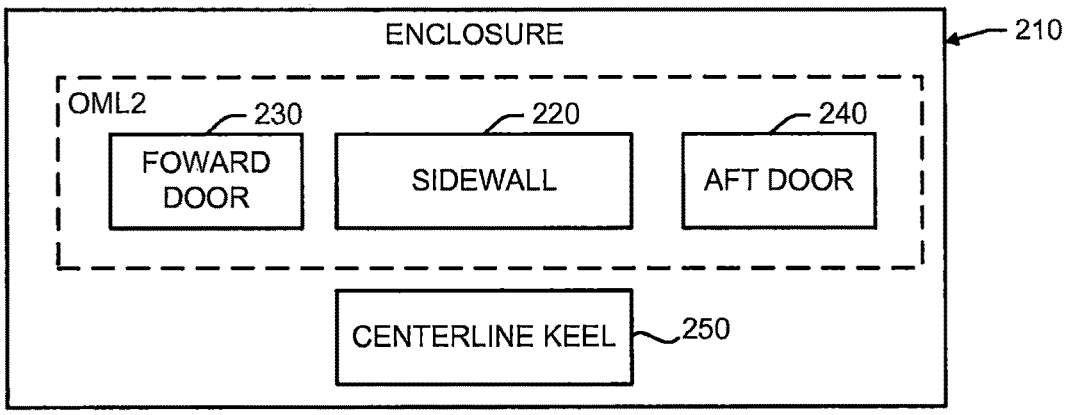
FIG. 1B is an illustration of an enclosure of the weapons pod.

Additional reference is made to FIG. 1B, which illustrates the enclosure 210 of the weapons pod 140. The enclosure 210 includes a sidewall 220, forward and aft doors 230 and 240, and a centerline keel 250. External surfaces of the sidewall 220 and the forward and aft doors 230 and 240 define an outer mold line (OML2) of the weapons pod 140. The forward and aft doors 230 and 240 may be independently opened and closed.

The sidewall 220 is stiff enough so the enclosure 210 maintains its original shape (and radar signature) following a missile launch. The sidewall 220 may be constructed from a fairing. In the alternative, the sidewall 220 may be constructed as a torque box, which provides optimum strength and stiffness while minimizing the weight. The torque box may include thin inner skin, thin outer skin, and frames between the inner and outer skin.

Inner surfaces of the sidewall 220 may be closed out and continuous. The continuous closed-out inner surfaces provide stiffness and strength and a better aerodynamic surface for instances when the doors 230 and 240 are open. The sidewall 220 may be made of composite material, and it may have a radar-absorptive coating.

Figure 4:
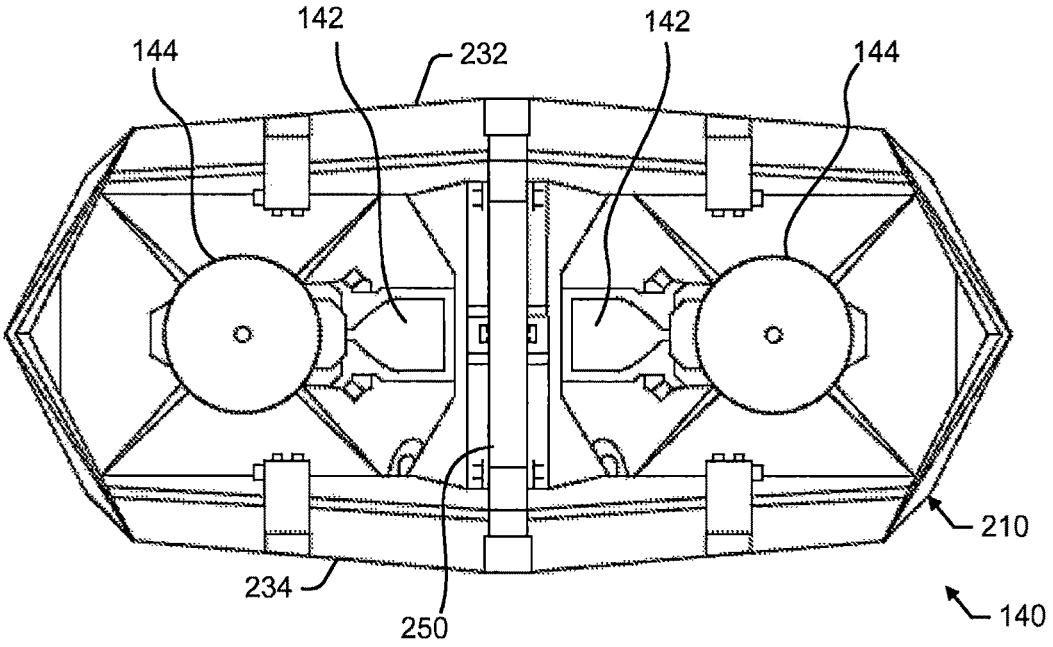

The forward and aft doors 230 and 240 may also have thin inner skin, thin outer skin, and frames between the inner and outer skin. In the alternative, the forward and aft doors 230 and 240 may be constructed as shown in FIG. 4: with outer skin and frames. The forward and aft doors 230 and 240 may also be made of composite material, and they may also have a radar-absorptive coating.

Figure 2:
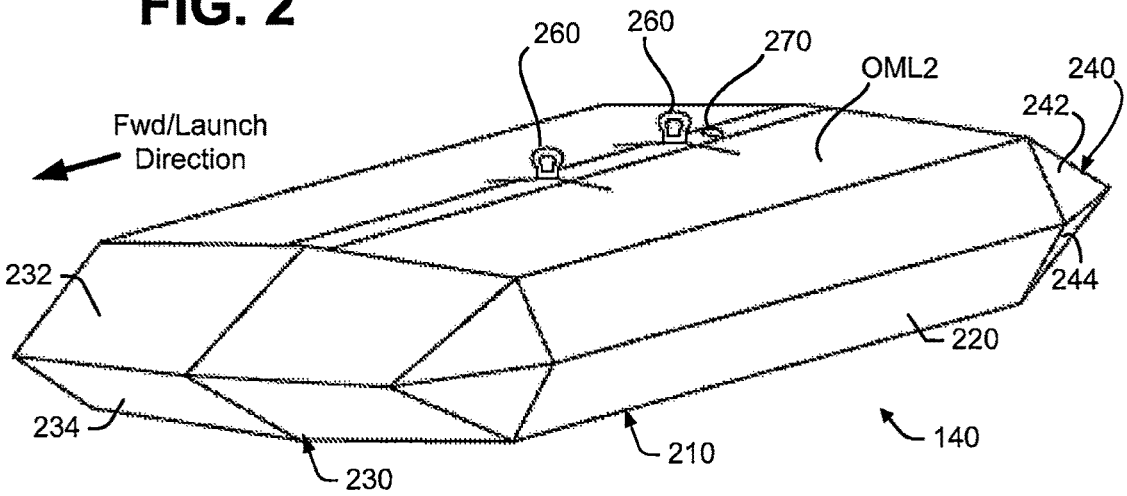
FIGS. 2-4 are illustrations of an example of the weapons pod.

FIG. 2 illustrates an example of a weapons pod 140. The outer mold line (OML2) of the weapons pod 140 is shaped to minimize aerodynamic drag and radar signature (FIG. 2 illustrates only one example of the shape).

FIG. 2 shows the forward and aft doors 230 and 240 closed. When closed, the forward and aft doors 230 and 240 hide the radar cross-section (RCS) of each missile 144. The. sidewall 220 hides the off-axis component of the RCSL: Thus, the enclosure 21 reduces observability of each rail launcher 142 and each missile 144.

Figure 3:
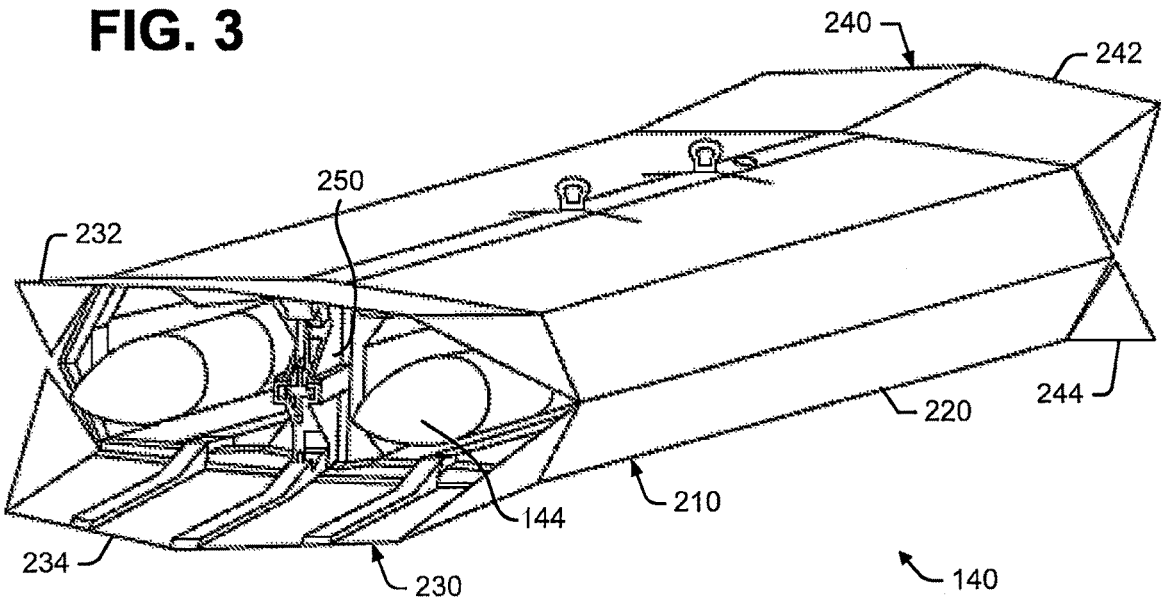

Additional reference is made to FIGS. 3 and 4, which show the forward and aft doors 230 and 240 opened. Two rail launchers 142 and two missiles 144 are exposed. The centerline keel 250 is also exposed. The rail launchers 142 are fixed to opposite sides of the centerline keel 250. The centerline keel 250 functions as a primary load-carrying member.

The centerline keel 250 may run the length of the sidewall 220. This helps to transfer aerodynamic loading on the interior and exterior of the enclosure 210 to attachment points on the weapons pod 140.

The attachment points may be standard military attachment points, such as two attachment lugs 260, for attaching the weapons pod 140 to the outer mold line of the aircraft 100. The weapons pod 140 may include a MIL-STD-1760 electrical connector 270.

Figure 5:
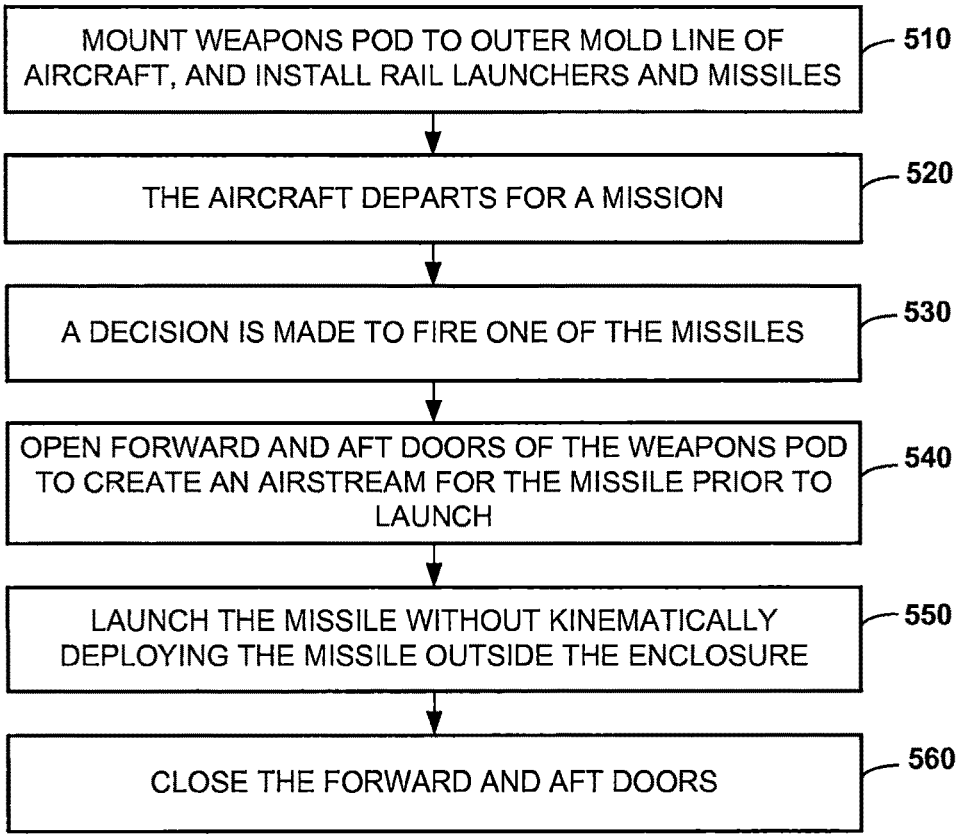
FIG. 5 is an illustration of a method of operating the weapons pod, including launching a missile from the weapons pod during flight of the aircraft.

Additional reference is now made to FIG. 5, which illustrates a method of operating the weapons pod 140. At block 510, the weapons pod 140 is mounted to the outer mold line (OML1) of the aircraft 100, and the rail launchers 142 and missiles 144 are installed in the enclosure 210. In a first instance, the rail launchers 142 and missiles 144 may be installed in the weapons pod 140, which is then mounted to the outer mold line of the aircraft 100. In a second instance, the weapons pod 140 may be mounted to the outer mold line (OML1) of the aircraft 100, and then the rail launchers 142 and missiles 144 are installed. The rail launchers 142 may be mounted to the centerline keel 250, and then the missiles 144 may be installed as needed. The weapons pod 140 may be provided with lower access doors (not shown) for rail launcher installation. The missiles 144 may be loaded from the forward portion of the enclosure 210 and slid into the rail launchers 142. When all ground operations for the weapons pod 140 have been completed, the forward door 230 and access doors (if any) are closed.

At block 520, the aircraft 100 departs for a mission. At block 530, a decision is made to fire one of the missiles 144 during the mission.

At block 540, the forward and after doors 230 and 240 are opened to create an airstream for the missile 144 prior to launch. The aft door 240 may be opened before the forward door 230 so as not to create a closed pod end that captures air and reduces aerodynamic efficiency.

At block 550, the missile 144 is powered up. When the forward and aft doors 230 and 240 reach their fully open positions, the rail launcher 142 is unlocked, and the missile's rocket motor is initiated. The missile 144 is launched from the rail launcher 142 without kinematically deploying the missile 144 outside of the enclosure 210.

The weapons pod 140 will not be damaged by the hot plume of a missile 144. during a normal launch, since the sidewall 220 runs parallel to the path of the missile 144 and will only see glancing impact from the plume. In addition, the launch event happens so quickly that the sidewall 220 will not have time to heat up and be damaged.

In the event of a hang-fire, the rocket motor is launched but stays locked to the rail of the rail launcher 142. In this event the missile plume does not damage the enclosure 210 due to sustained heating because the aft door 240 is open and the missile plume exits the weapons pod 140.

At block 560, the forward and aft doors 230 and 240 are closed immediately after the missile 144 has cleared the enclosure 210. While the doors 230 and 240 are open, the aerodynamic and radar signature characteristics of the aircraft 100 are impacted. For this reason, the door opening and closing durations are minimized.

The weapons pod 140 may be jettisoned after all missiles 144 have been fired.

In some configurations of the weapons pod 140, including the configuration illustrated in FIGS. 2-4, the forward and aft doors 230 and 240 may have a clamshell configuration that provides symmetric loading during opening and closing. In the clamshell configuration, the forward door 230 includes upper and lower sections 232 and 234, and the aft door 240 includes upper and lower sections 242 and 244. Each section pivots on an axis.

Each door 230 and 240 may be balanced. That is, the upper and lower sections 232 and 234 of the forward door 230 are of equal size and shape, and the upper and lower sections 242 and 244 of the aft door 240 are of equal size arid shape. When the upper and lower sections 232 and 234 of the forward door 230 are closed, they make contact at a midplane (waterline) of the enclosure 210. Similarly, when the upper and lower sections 242 and 244 of the aft door 240 are closed, they make contact at the midplane. Balanced door sizes help to balance upward and downward loads and moments (pitch) on the weapons pod 140. If one of the sections were eliminated or made significantly larger than the other section, the loads would be unbalanced and would drive additional load into the enclosure 210. This would increase weight and complexity of the weapons pod 140.

Figure 6:
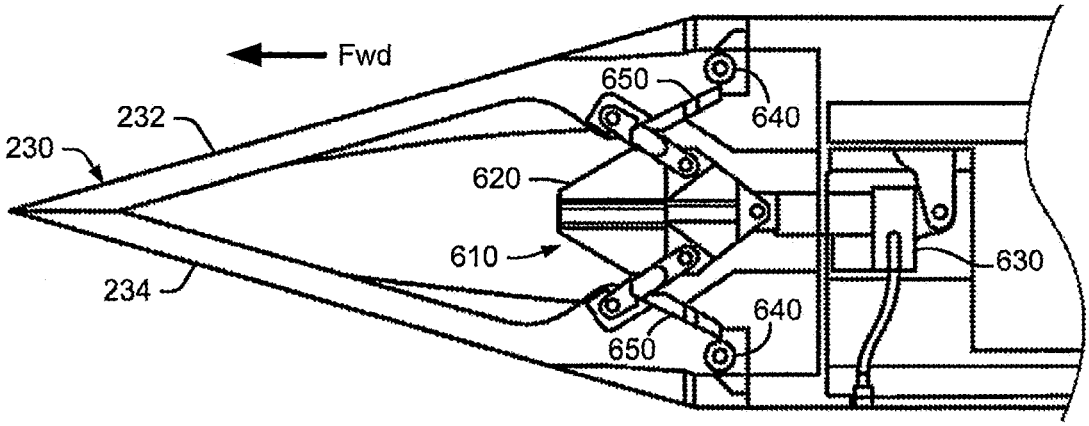
FIGS. 6 and 7 are illustrations of a forward door of the weapons pod and a drive mechanism for opening and closing the forward door.
Figure 7:
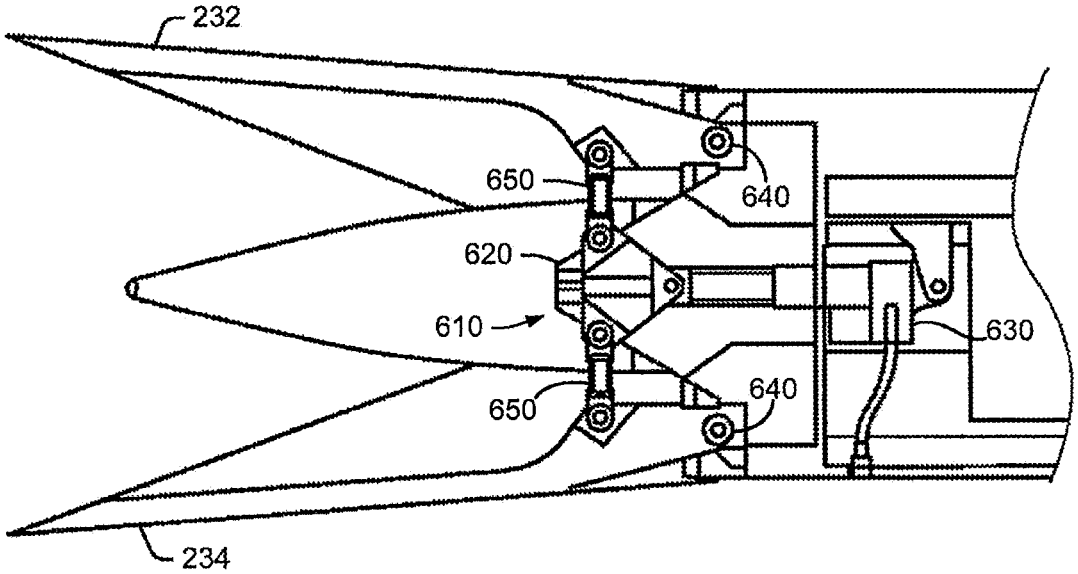

Reference is now made to FIGS. 6 and 7, which illustrate a drive mechanism 610 for opening and closing the forward and aft doors 230 and 240. The drive mechanism 610 includes a door block 620 slidable along a rail or track, and a door actuator 630 (e.g., a screw actuator) that causes the door block 620 to slide forward and aft. Each section 232 and 234 of the forward door 230 is hinged by a hinge 640. The sections 232 and 234 are connected to the door block 620 by mechanical links 650.

The aft door 240 may be opened and closed by a similar drive mechanism 610. The forward and aft doors 230 and 240 may be driven independently by separate drive mechanisms 610.

Figure 8:
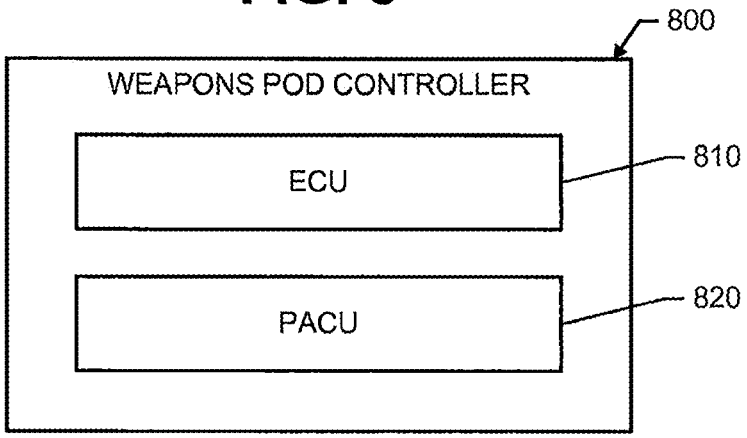
FIG. 8 is an illustration of a weapons pod controller.

Reference is now made to FIG. 8, which illustrates a controller 800 for the weapons pod 140. Each of the door actuators 630 may be controlled by an Electronic Control Unit (ECU) 810. A Pod Armament Control Unit (PACU) 820 may control the armament functions of the weapons pod 140. The PACU 820 coordinates the opening and closing of the forward and aft doors 230. and 240 through the ECU 810. The PACU 820 also provides the logical interface between the weapons pod 140 and the aircraft's Stores Management System (not shown).

The Store Management System provides an interface between the pilot and the missiles 144. The Store Management System may communicate to the ECU 810 and the PACU 820 information including status of the missile(s) 144, and it may initiate a launch command. Once the launch command has been received, the ECU 810 and the PACU 820 control the weapons pod 140, including the rail launchers 142, and the missiles 144.

Figure 9:
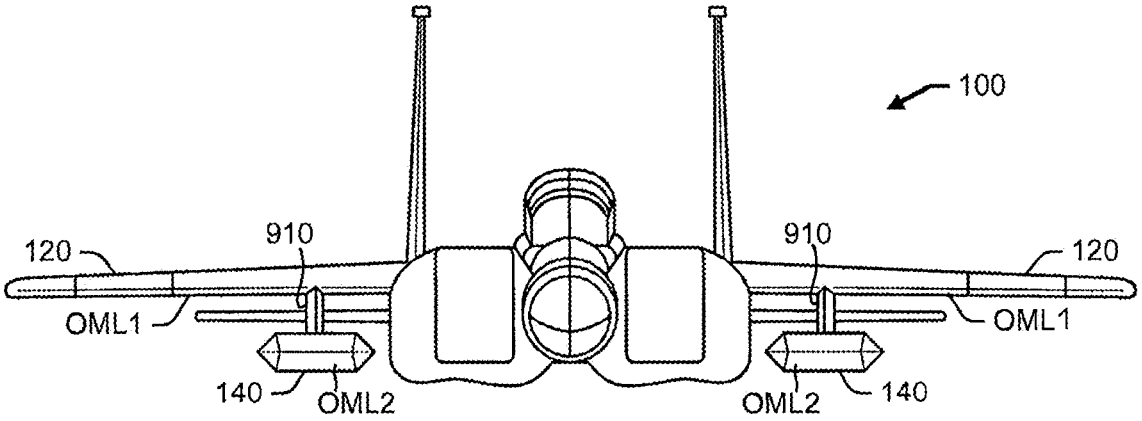
FIG. 9 is an illustration of an aircraft including two wing-mounted weapons pods.

FIG. 9 illustrates an aircraft 100 in which pylons 910 mount two weapons pods 140 to outer mold lines of the wings 120. For each weapons pod 140, the centerline keel 250 is mounted in-line to the pylon 910 so as to transmit launch loads to the pylon 910.

By moving the missiles 144 into the weapons pod 140, internal volume of the Aircraft 100 is freed up. In addition, aerodynamic drag on the rail launchers 142 and missiles 144 is reduced.

The combination of the fixed rail launcher 142 and forward and aft doors 230 and 240 eliminates the need for kinematically deploying the missiles 144 outside of the enclosure 210 prior to launch. As a result, weight and complexity is reduced. Deployment time of the missile is faster which significantly increases the overall missile launch time. Additionally, ejection launch drives significant load into the weapons pod frame and in turn reduces load and structural complexity.

A weapons pod 140 herein is not limited to forward and aft doors 230 and 240 that open and close. In some configurations, the forward and aft doors may be frangible. The frangible doors are closed after the missiles 144 are loaded, and they are broken prior to missile launch or they are broken by the missiles. The frangible doors do not close after launch.

What is claimed:

1. A system comprising:
a weapons pod including an enclosure configured to be mounted on an aircraft,
wherein the enclosure includes a forward door portion comprising an upper section and a lower section that are opened and closed by independent drive mechanisms, and
wherein the enclosure includes an aft door portion comprising an upper section and a lower section that are opened and closed by independent drive mechanisms; and
at least one rail launcher mounted to the enclosure.

2. The system of claim 1, wherein the upper sections and the lower sections of the forward door portion and the upper sections and the lower sections of the aft door portion make contact at a midplane when the forward door is closed.

3. The system of claim 1, wherein the independent drive mechanisms comprise:
a door block configured to slide along a track,
wherein the upper sections and the lower sections of the forward door portion and the upper sections and the lower sections of the aft door portion are connected to the door block; and
a door actuator configured to cause the door block to slide.

4. The system of claim 1, wherein the at least one rail launcher is configured to carry a weapon.

5. The system of claim 1, wherein the forward door portion and the aft door portion are configured to create an airstream through the enclosure prior to launching a weapon.

6. The system of claim 1, wherein the aft door portion is configured to open before the forward door portion to improve aerodynamic efficiency during operation.

7. The system of claim 1, wherein the weapons pod is configured to be jettisoned.

8. The system of claim 1, wherein the forward door portion and the aft door portion are frangible,
wherein the forward door portion and the aft door portion are configured to close after weapons are loaded into the enclosure, and
wherein the forward door portion and the aft door portion are configured to break prior to weapons launch or broken by the weapons launch.

9. A method comprising:
opening and closing, by a device, a forward door and an aft door of an enclosure of a weapons pod,
wherein the enclosure is configured to be mounted on an aircraft,
wherein the forward door includes an upper section and a lower section that are opened and closed via independent drive mechanisms, and
wherein the aft door includes an upper section and a lower section that are opened and closed via independent drive mechanisms; and
controlling, by the device, at least one rail launcher mounted to the enclosure.

10. The method of claim 9, wherein the upper sections and the lower sections of the forward door and the upper sections and the lower sections of the aft door make contact at a midplane when the forward door is closed.

11. The method of claim 9, further comprising:
providing an interface between the weapons pod and a management system of the aircraft; and
controlling armament functions of the weapons pod.

12. The method of claim 9, further comprising:
sliding, by controlling a door actuator, a door block along a track,
wherein the upper sections and the lower sections of the forward door and the upper sections and the lower sections of the aft door are connected to the door block.

13. The method of claim 9, wherein the at least one rail launcher is configured to carry a weapon.

14. The method of claim 9, further comprising:
opening the aft door before the forward door to improve aerodynamic efficiency during operation.

15. A non-transitory computer-readable medium storing a set of instructions, the set of instructions comprising:
one or more instructions that, when executed by one or more processors of a device, cause the device to:
open and close a forward door and an aft door of an enclosure of a weapons pod,
wherein the enclosure is configured to be mounted on an aircraft,
wherein the forward door includes an upper section and a lower section that are opened and closed via independent drive mechanisms, and
wherein the aft door includes an upper section and a lower section that are opened and closed via independent drive mechanisms; and
control at least one rail launcher mounted to the enclosure.

16. The non-transitory computer-readable medium of claim 15, wherein the upper sections and the lower sections of the forward door and the upper sections and the lower sections of the aft door make contact at a midplane when the forward door is closed.

17. The non-transitory computer-readable medium of claim 15, wherein the one or more instructions further cause the device to:
provide an interface between the weapons pod and a management system of the aircraft; and
control armament functions of the weapons pod.

18. The non-transitory computer-readable medium of claim 15, wherein the independent drive mechanisms comprise:
a door block configured to slide along a track, wherein the upper sections and the lower sections of the forward door and the upper sections and the lower sections of the aft door are connected to the door block, and a door actuator configured to cause the door block to slide; and wherein the one or more instructions further cause the device to:

control the door actuator.

19. The non-transitory computer-readable medium of claim 15, wherein the at least one rail launcher is configured to carry a weapon.

20. The non-transitory computer-readable medium of claim 15, wherein the one or more instructions further cause the device to open the aft door before the forward door to improve aerodynamic efficiency during operation.

* * * * *